United States Patent [19]

Gallis et al.

[11] 4,356,993

[45] Nov. 2, 1982

[54] CORNER FORMING APPARATUS FOR A CONCRETE WALL FORM

[75] Inventors: Anthony J. Gallis, Lake Hiawatha, N.J.; Prabh S. Ahluwalia, Brooklyn, N.Y.

[73] Assignee: Harsco Corporation, Camp Hill, Pa.

[21] Appl. No.: 225,203

[22] Filed: Jan. 15, 1981

[51] Int. Cl.[3] ..... B28B 7/00; B28B 7/34

[52] U.S. Cl. ..... 249/27; 249/38

[58] Field of Search ..... 249/219 R, 219 W, 23, 249/25, 26, 27, 38, 39, 40, 44, 45, 47, 189, 190, 191, 192, 216, 218

[56] References Cited

U.S. PATENT DOCUMENTS

| | | | |
|---|---|---|---|
| 999,030 | 7/1911 | Hodge | 425/213 |
| 1,051,329 | 1/1913 | Hibbard | 249/40 |
| 1,212,499 | 1/1917 | Kemon | 249/193 |
| 2,313,880 | 3/1943 | Leggett | 249/27 |
| 2,618,834 | 11/1952 | Fioruzzi | 249/20 |
| 2,789,337 | 4/1957 | Arrighini | 249/194 |
| 2,826,801 | 3/1958 | Imonetti | 249/188 |
| 3,077,653 | 2/1963 | Ward | 249/196 |
| 3,288,427 | 11/1966 | Plückebaum | 249/47 |
| 3,477,684 | 11/1969 | Dagiel | 249/189 |
| 3,661,354 | 5/1972 | Dagiel | 249/192 |
| 3,672,626 | 6/1972 | Thornton | 249/48 |
| 3,778,020 | 12/1973 | Burrows | 249/219 R |
| 4,142,343 | 3/1979 | Trafton | 52/721 |
| 4,144,690 | 3/1979 | Avery | 52/376 |

OTHER PUBLICATIONS

Anon., "Outside Corner Strongback", Data Sheets, pp. 9–19, 12–1979 & 2–1979 (pp. 84–5604), Alumina Building Systems, Inc.

*Primary Examiner*—W. E. Hoag

*Attorney, Agent, or Firm*—Curtis, Morris & Safford

[57] ABSTRACT

Corner forming apparatus is disclosed, including a novel generally L-shaped member having a seating flange projecting from one leg of the member substantially parallel to the other leg. The seating flange is adapted to shield an edge of a panel when the panel is seated on the seating flange. The other leg of the L-shaped member is securable to a panel-support beam member mounted on the back of said panel, and is provided with at least one aperture therein to receive fastening elements for securing another panel to the other leg such that a surface of the other panel and the outer surface of said one leg are substantially coplanar.

Also a unique outside corner waler useful with the inside corner forming member in quick and accurate assembly of a complete corner wall form. Said waler having a major leg and a minor leg each joined at one end at right angles by an apertured web and being of respectively different heights such that said waler seats at about a 45° angle.

23 Claims, 7 Drawing Figures

CORNER FORMING APPARATUS FOR A CONCRETE WALL FORM

BACKGROUND OF THE INVENTION

This invention relates to an assembly for use with concrete wall forms and, more particularly, to an inside corner forming member alone or in combination with such assembly and/or outside corner walers.

In concrete wall construction, the wall form typically is assembled at a job site. Even today these forms are often custom-built from wooden studs sheathed with plywood for one-time use. Advantageously, on larger construction sites, reusable mobile wall forms are used, typically ganged together and shifted as the height and length of the concrete wall is formed.

Various structures are used as backing support to the plywood panels so as to resist the forces exterted on those wall form panels during the formation of the concrete walls. As one example of such support structures, wooden studs are secured to the panel and then load-gathering horizontal wales are secured to the vertical studs, with the latter occasionally backed by vertical strongbacks, thereby providing a rigid support for the panel. In a more modern application, the panels are backed by horizontal joists, or beams, which in turn are secured by vertical steel double-channel wales. Recently, these joists and wales have been formed of aluminum, resulting in light weight, easily handled, strong, and rigid components, relatively easy to manufacture, and readily reusable.

These structures are described in various editions of *Formwork for Concrete* by M. K. Hurd published by the American Concrete Institute since 1963 (e.g. see FIGS. 4–11, 6–2, 9–34, 9–35, and 11–17 of the 2d edition).

An example of on site concrete molds constructed of such wall forms is described in U.S. Pat. No. 4,144,690. Even today custom-built wood corners remain the standard construction technique. This is true in spite of numerous suggested improvements over the years. See for example, U.S. Pat. Nos. 1,051,329, 2,313,880, 2,789,337, and 2,826,801.

In another problem with the prior art, the edge of the plywood panel used to form the inside corner is not protected. This means that the edge often becomes chipped or split when that panel is shifted to other locations or is otherwise manipulated. This can affect the integrity of the mold (causing leaks), the quality of the finished concrete, as well as the life of the panels; thus adding to the expense of construction.

Also, many inside corner forming members generally are secured only to the panels which are used therewith. Without additional rigid support, the inside corner assembly may be undesirably weak.

OBJECTS OF THE INVENTION

Therefore, it is an object of the present invention to provide corner forming apparatus which avoid the aforenoted disadvantages.

Another object of this invention is to provide an improved inside corner concrete form assembly which is relatively inexpensive to manufacture, exhibits desirable rigidity, and can be easily and quickly reused at other locations on a job site.

A further object of this invention is to provide an inside corner forming member which can be rigidly secured to a particular panel and then used with that panel, in conjunction with another panel, to form either an inside corner or, when a corner is not needed, may be used merely as an extension in a wall form (without the need to remove the inside forming member).

A still further object of this invention is to provide protection of the forming edge of the inside panel from damage which may be caused during transport, assembly, disassembly, and other handling; to insure a good architectural finish.

An additional object of this invention is to provide an inside corner forming member which is used with conventional fastening hardware such that it can be easily and quickly assembled when originally setting up the wall form.

Yet another object of this invention is to provide an improved inside corner concrete form assembly on one wall form, which assembly can be easily and quickly joined and/or detached from a second conventional wall form to give the desired inside corner form assembly and which joinder can be made with conventional elements without requiring the use of additional and unique fastening hardware, thereby reducing the necessary inventory required at the job site and, concomitantly, thereby reducing the overall cost of forming a concrete structure.

In this specification and the accompanying drawings, Applicants have shown and described several preferred embodiments of their invention and have suggested various alternatives and modifications thereto, but it is to be understood that these are not intended to be exhaustive and that many changes and modifications can be made within the scope of the invention. These suggestions herein are selected and included for purposes of illustration in order that others skilled in the art will more fully understand the invention and principles thereof and will thus be enabled to modify it and embody it in a variety of forms, each as may be best suited to the conditions of a particular use.

SUMMARY OF THE INVENTION

In accordance with this invention, an inside corner forming member is provided for joining a pair of wall forms at right angles in constructing an inside corner. The member is securable to the wall form panels and to the stiffening joists attached to the back of said panels.

The corner forming member is substantially L-shaped and has a seating flange projecting from the inner surface of one leg thereof at an intermediate location therealong. The seating flange is generally perpendicular to the one leg, (i.e., substantially parallel to the other leg of the L-shaped member). The length of that portion of the one leg which extends beyond the seating flange is substantially equal to the thickness of the forming panels and is adapted to shield those edges of such panels which are seated on the flange. The panels preferably are 4 foot by 8 foot by $\frac{3}{4}$ of an inch plywood sheets. Typically, one to three panels will be used with each inside corner forming member. The panels may be secured to the seating flange by conventional fastening means, such as unslotted flat-headed carriage bolts. The other leg of the L-shaped member is securable to the panel joists and has at least one aperture therein to receive a fastening assembly for securing other wall form to to this other leg (such that a surface of said other wall form and the outer surface of the aforementioned one leg are substantially coplanar. Preferrably, the apertures in said other leg are vertically-aligned horizontally-oriented rectangular slots which mate with similar wedge bolt slots in an angle iron (the latter being a conventional fixture) mounted on the adjacent vertical edge of the other wall form. In a preferred embodiment, the L-shaped member is constructed of aluminum, and the projecting seating flange is of unitary construction therewith. Preferably, the aforementioned other leg of the L-shaped member is Z-shaped and terminates in an end portion that is offset from the juncture defined by the legs of the L-shaped member. This offset enables the corner assembly to be quickly and easily disconnected from the adjacent wall form and stripped from the set concrete wall.

Preferably, the joists secured to the wall form panels have clip members coupled thereto. Such clip members terminate in a hook which engages a flange provided on the offset end portion of the Z-shaped leg of the L-shaped member. Said L-shaped members are typically 8 to 16 feet high, having one to three 4×8 plywood panels attached to said seating flange. The horizontal joists between the plywood panels can conventionally be backed by nailer strips in said joists.

BRIEF DESCRIPTION OF THE DRAWINGS

The following detailed description, given by way of example, will best be understood in conjunction with the accompanying drawings in which.

DETAILED DESCRIPTION OF A PREFERRED EMBODIMENT

Figure 1:
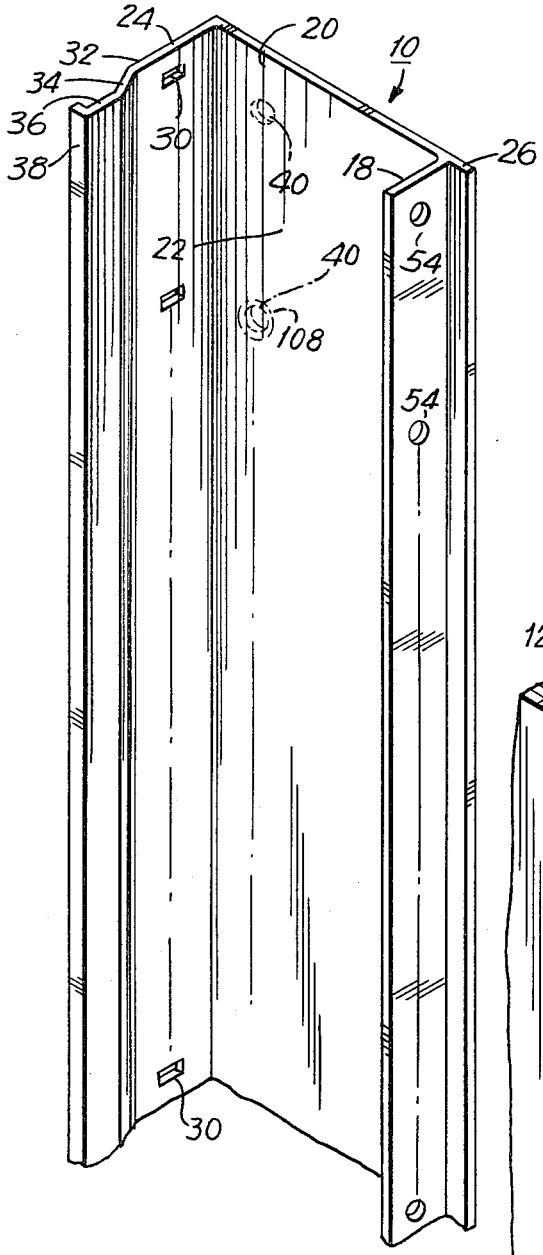
FIG. 1 is an isometric view of the inside corner forming member in accordance with the present invention.
Figure 2:
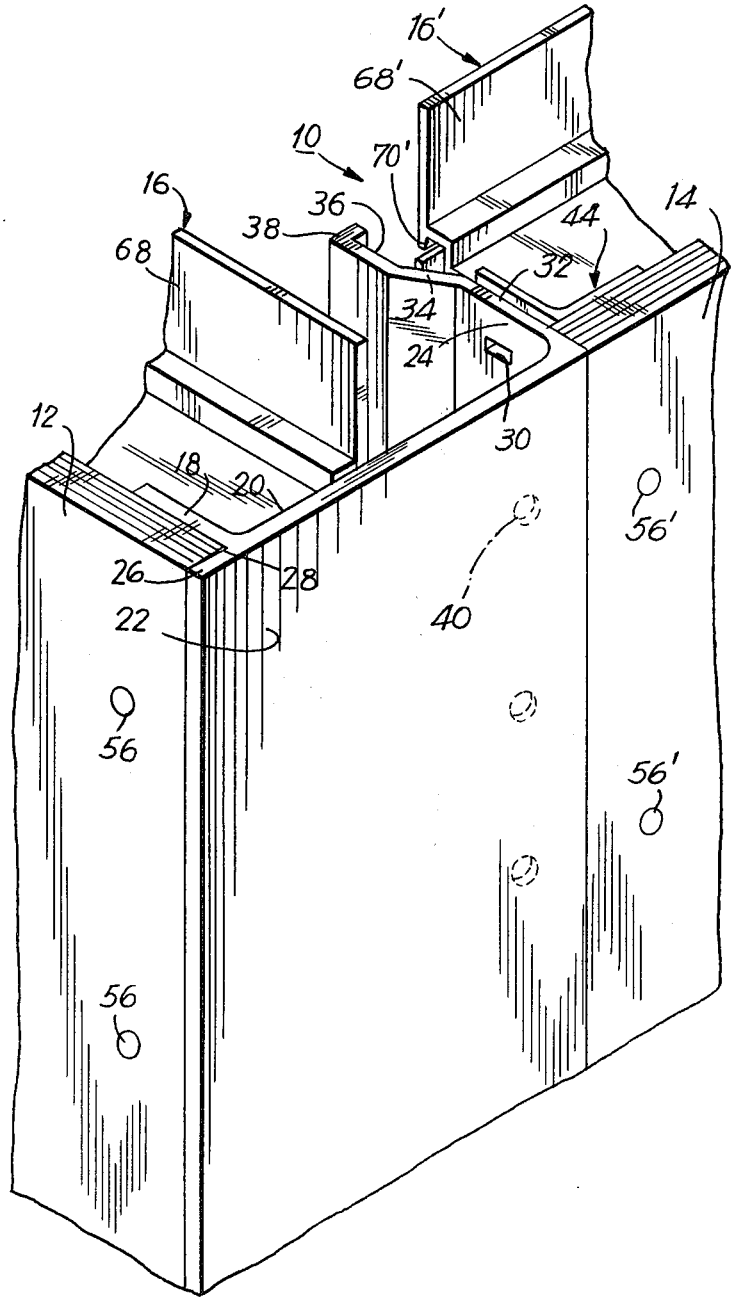
FIG. 2 is an isometric view of the use of this inside corner forming member attached to the plywood panel and joist of one wall form and joined at right angles to a second wall form.
Figure 3:
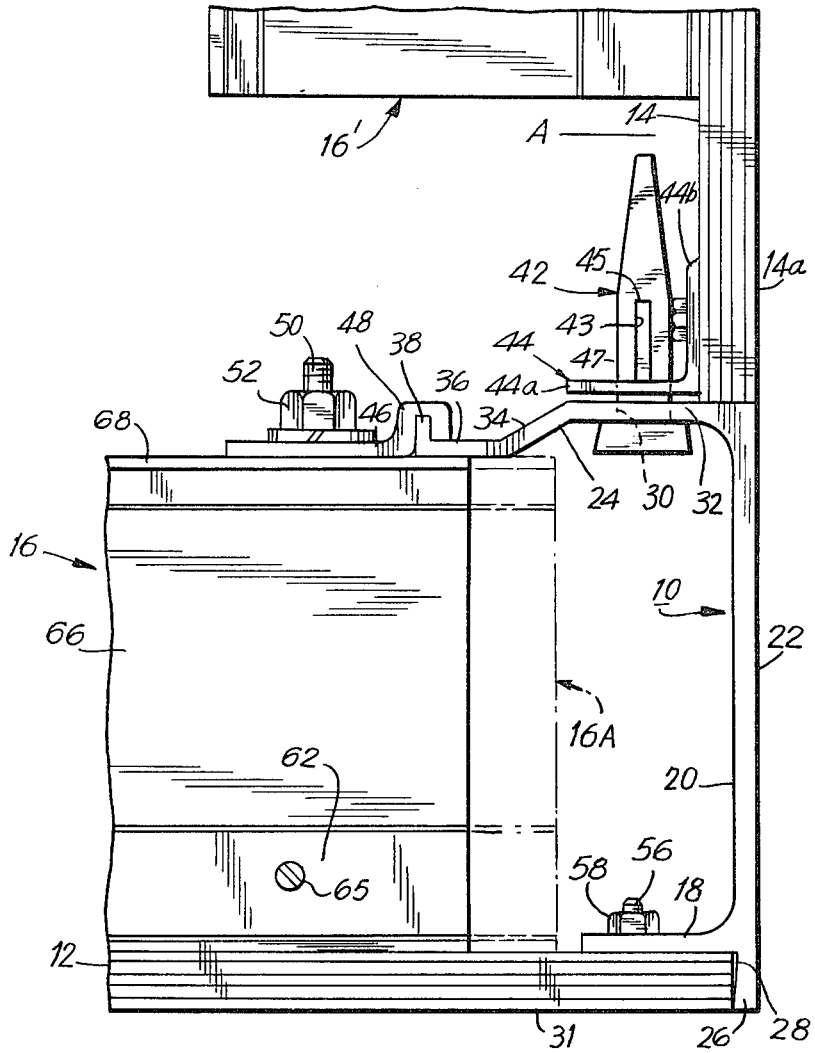
FIG. 3 is a plan view of the combination shown in FIG. 2.

Referring now to the drawings, FIGS. 1–3 illustrate the inside corner forming member 10 as being substantially L-shaped with a pair of legs 22 and 24. In one embodiment the inside corner forming member is constructed of extruded aluminum, and the respective legs are of unitary construction therewith. A seating flange 18 projects from inner surface 20 of leg 22 in a direction substantially parallel to leg 24. Seating flange 18 is disposed at an intermediate location along leg 22 such that an extension 26 of this leg is formed. As best seen in FIG. 3, the inner surface of extension 26 and the seating flange 18 form an acute angle of slightly less than 90° with respect to each other.

Leg 24 is substantially Z-shaped and includes a first portion 32, which extends at a substantially right angle from its intersection with leg 22. This first portion 32 ends in an angle portion 34 which angles back in the direction of the seating flange 18. Angle portion 34 ends in a second portion 36 which is substantially parallel to first portion 32. Thus, second portion 36 is seen to be offset from the juncture defined by legs 22 and 24 by reason of angle portion 34. This second portion 36 of leg 24 terminates in a flange 38 (used to secure the L-shaped inside corner forming member 10 to a panel-support beam member 16). Leg 24, and particularly first portion 32 thereof, is provided with a plurality of apertures 30 which extend along a longitudinal axis and which are spaced from each other by generally standard distances, see FIG. 1 (these can be circular holes or preferably are rectangular wedge bolt slots).

When assembled to form an inside corner, L-shaped member 10 is secured, or fastened to a pair of panels 12 and 14. Typically, these panels are made up of one or more sheets of plywood. Thus, two horizontally oriented 4′×8′ sheets of plywood 12 would be fastened to flange 18 of an 8 foot L-shaped member 10.

FIGS. 2 and 3 illustrate the assembly of L-shaped member 10 with panels 12 and 14 to form an inside corner. An end portion of the inside surface of panel 12 seats upon seating flange 18, and the edge 28 of panel 12 seats against extension 26. Generally, edge 28 is at right angles with the inner surface of panel 12. However, in FIG. 3, the inside surface of extension 26 is not at right angles with seating flange 18. This acute angle defined by the seating flange and extension serves to assure a close fit with the outer portion of edge 28 (to protect the latter and accommodate any already existing chips or distortions). Panel 12 is fastened to seating flange 18 by means of bolts 56 which pass through suitable openings in the panel, and also through holes 54 in the seating flange (the foregoing herein identified as a second fastening means). Nuts 58 serve to tighten and suitably secure the bolts, whereby panel 12 is rigidly fastened to one leg 22 of L-shaped member 10.

Figure 6:
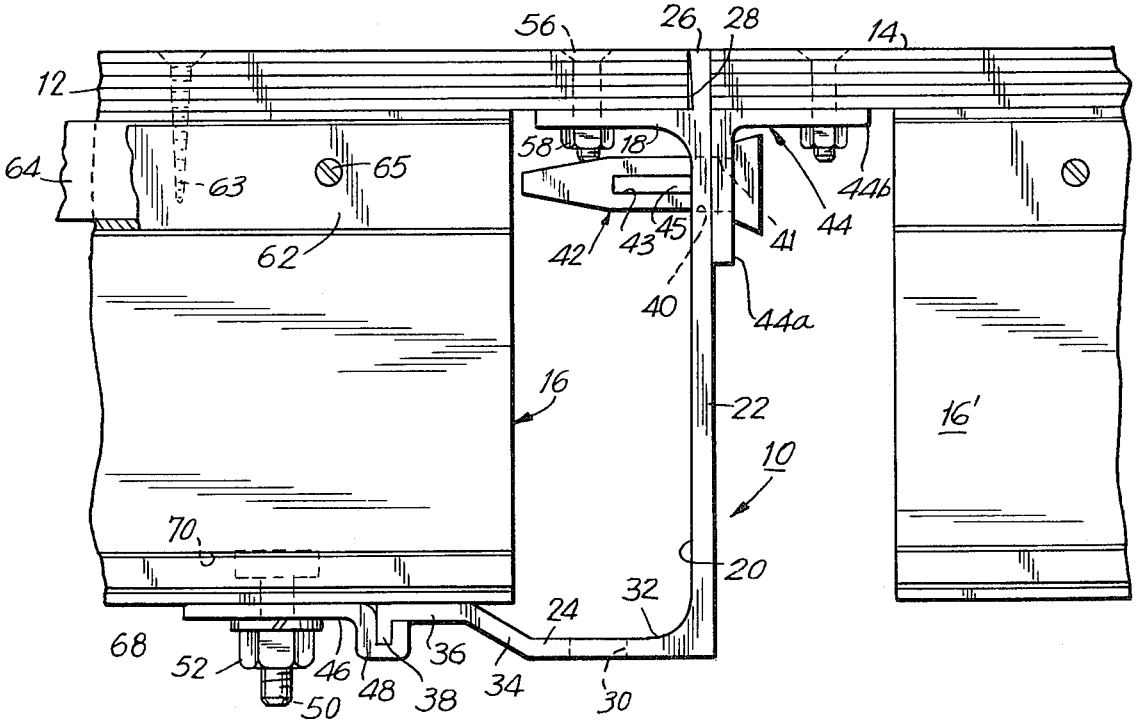
FIG. 6 is a top view of the inside corner forming member used in another alignment to demonstrate the flexibility thereof, for linear in lieu of corner orientation.
Figure 4:
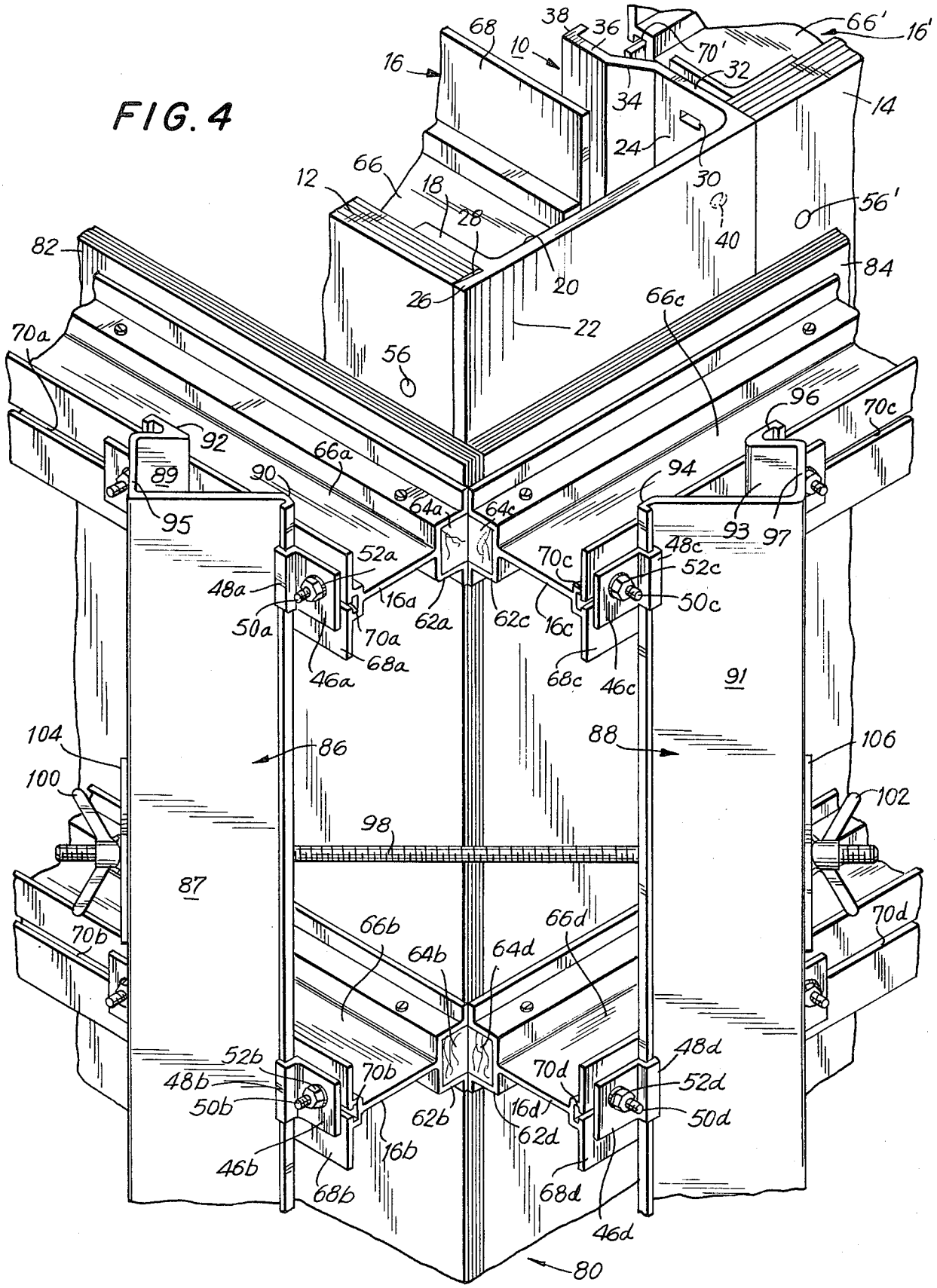
FIG. 4 is an isometric view of the combination of the inside corner forming member and unique outside corner forming assembly for use in forming a poured concrete corner wall.

Typically, and as mentioned above, plywood panels 12 and 14 when used in modern wall forms are supported by aluminum joists 16, and walers (not shown). The typical joist 16 has a web 66 interconnecting a top hat channel 62 and a base flange 68. In wall forms, such joists 16 extend generally horizontally. As best shown in FIGS. 4 and 6, flange 68 has a bolt slot channel 70 adapted to receive the head of a bolt 50. This bolt 50 serves to secure a fastening clip 46. The position of clip 46 along the length of joist 16 is readily adjustable merely by sliding bolt 50 in channel 70.

As seen in FIG. 3, clip 46 has a hook 48 for grasping a flange, such as 38 provided on Z-shaped leg 24. Thus, the third fastening means may comprise one or all of the fastening clip 46, hook 48, and flange 38, which cooperatively secure leg 24 to joist 16. This joist 16 is secured to panel 12 by nails 63 (see FIG. 6). The nails 63 are driven into a two by three inch wooden nailer strip 64, which latter is fastened in the U-shaped top hat channel 62 by screws 65. Similarly, joists 16′ are nailed onto panel 14.

Preferrably, the length of extension 26 beyond seating flange 18 on leg 22 is substantially equal to the thickness of panel 12 (see FIG. 3). Thus, when L-shaped member 10 is secured to panel 12, edge 28 is shielded by extension 26 so as to minimize damage to this edge. More importantly, the inside corner edge of the wall form is now defined by the outer ring-angle planar metal surfaces of extension 26, and not by the wood of edge 28.

As best shown in FIG. 3, an angle iron 44, comprised of legs **44*a* and 44*b*, is secured to the inner surface of panel 14, preferably such that leg 44*a* is slightly spaced from the free edge thereof. Suitable carriage bolts and nuts may be used to fasten angle iron 44 to panel 14**.

Leg 44*a* is provided with a series of slots 47 therein such that, when panel 14 having angle iron 44 secured thereto is aligned with L-shaped member 10, these slots 47 are in alignment with the slots 30 provided in leg 24. Then, fasteners, such as wedge bolts 42, pass through aligned apertures 30 and 47. Wedge bolt 42 has a slot 43 therein, this slot being adapted to receive a wedge bolt 45. As wedge bolt 45 is forceably driven into slot 43, angle iron 44 is forced towards leg 24, and the free end of panel 14 is butted against the outer surface of leg 24, resulting in the configuration shown in FIG. 3. It may be seen that when angle iron 44 is suitably fastened to leg 24, leg 44*a* is preferably slightly spaced from leg 24. This insures that the free end of panel 14 is driven into proper tightly abutting relationship with respect to the outer surface of leg 24.

The particular dimensions of leg 24 and of angle iron 44, and the location of the respective slots 30 and 47, are such that when panel 14 is fastened to leg 24, the outer surface 14*a* of the panel and the outer surface of leg 22 of the L-shaped member 10 exhibit an essentially coplanar relationship. Thus, an inside corner is formed between the outer surface of panel 12 (including the outer end surface of extension 26, which together define one wall of the corner), and the outer surface of panel 14 (including the coplanar outer surface of leg 22, which together define the other wall of the corner).

In normal operation, the L-shaped member 10 remains fastened to panel 12 and to its joists 16 in the illustrated manner. Thus, to form the inside corner forming mold, panel 14 is secured to leg 24 of the L-shaped member. This fastening operation is carried out quickly and easily by the first fastening means, namely by inserting wedge bolts 42 into properly aligned apertures in leg 24 and in angle iron 44 and securing it with wedge bolt 45. To disassemble this assembly, wedge bolt 45 is removed from slot 43 and wedge bolt 42 is withdrawn from the aligned apertures. Then, by reason of the illustrated offset 34, panel 14 (together with the joists 16' secured thereto) may be stripped away from the set concrete wall in the direction indicated by arrow A, and then swung free of the L-shaped member 10. The offset between flange 38 at the terminating end of leg 24 and the juncture between legs 22 and 24 permits this relatively free and unobstructed movement of the wall form comprising panel 14. Panel 14 then may be re-used in additional assemblies, such as in a straight-wall forming assembly, another corner-forming assembly, or the like. Panel 12, carrying L-shaped member 10, can be re-used for constructing a new inside corner assembly (or as described below with respect to FIG. 6 may be used in straight wall forming).

Figure 5:
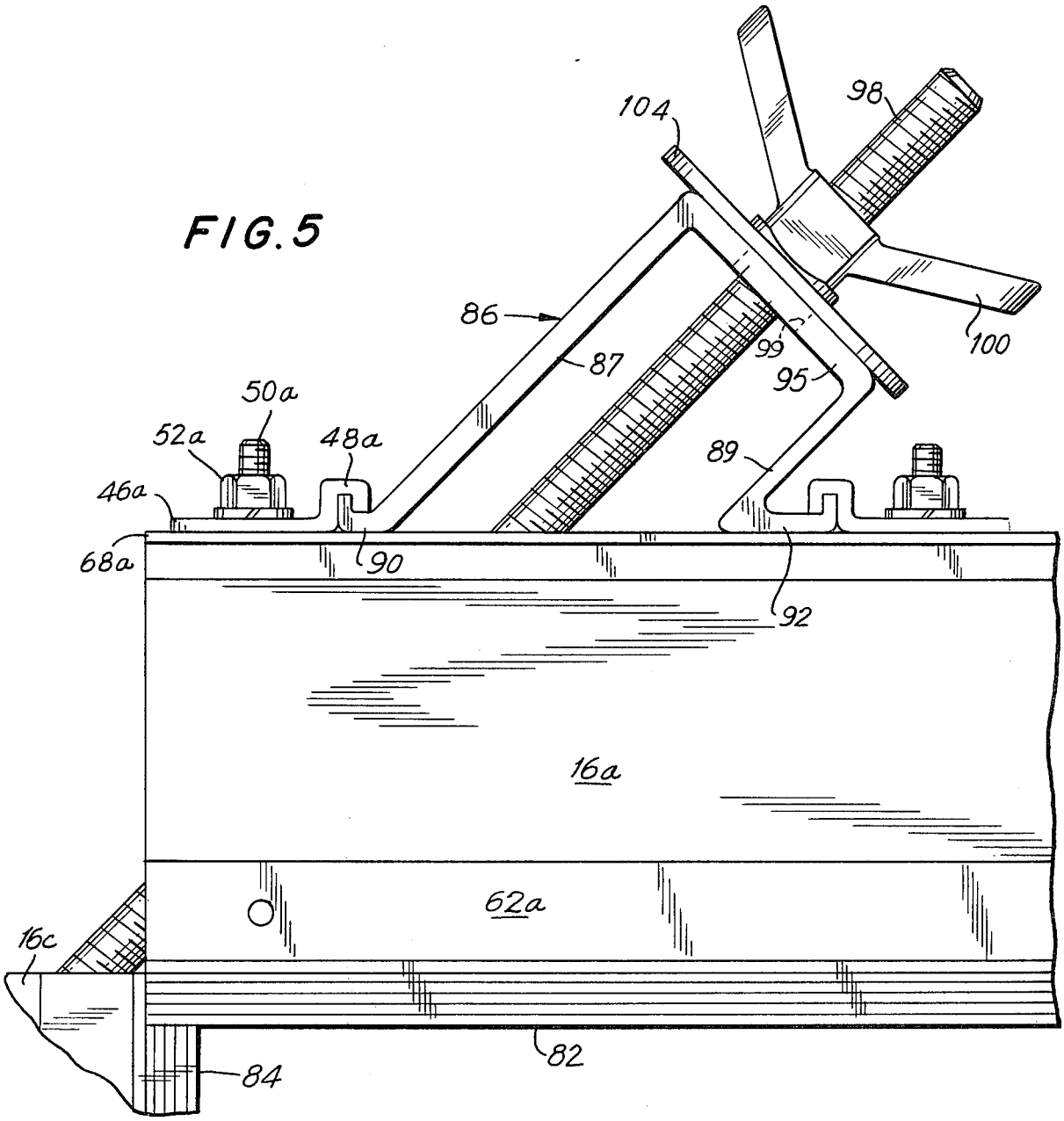
FIG. 5 is a plan view of an outside corner waler and tie rod assembly mounted on a wall form joist.

Turning now to FIGS. 4 and 5, there is illustrated in combination with the inside corner forming member 10, an outside corner form assembly 80.

Outside corner form assembly 80 is comprised of a pair of angularly abutting panels 82 and 84. When combined with the inside corner form assembly described above, typically panels 82 and 84 will be parallel to and spaced from panels 12 and 14. These can be exteriorly braced or interiorly joined by conventional tie rods (not shown). For convenience, the same reference numerals, but with differentiating letter designations, are used to identify similar elements. For an example, two horizontal joists 16*a* & *b* are shown secured to the outer surface of panel 82.

Outside corner aluminum walers 86 and 88, of a new design are shown vertically mounted across the horizontal joists 16*a* & *b* and 16*c* & *d* by fastening clips 46*a* etc. Fastening clips 46*a* & *b* clamp the lips of flanges 90 and 92; and similarly fastening clips 46*c* & *d* clamp the lips of flanges 94 and 96.

Corner waler 86 is formed of a major leg 87 and a minor leg 89 joined at right angles by a top web 95. Waler 88 similarly has legs 91 and 93 and web 97. The major and minor legs (such as 87 and 89) preferably are dimensioned so that they seat on the flange 68*a* of their respective joist 16*a* at approximately a 45° angle. Each top web 95 or 97 has a longitudinally disposed series of apertures 99 (see FIGS. 5 & 7) for accommodating a tie-rod 98 therethrough. Advantageously in an eight foot outside corner waler, there would be seven $4'' \times 1\frac{1}{4}''$ apertures. The tie-rod 98 passes through such an aperture 99 and is secured to waler 86 by means of a wing nut 100. Nut 100 preferably seats against a reinforcing thrust plate 104. Similarly, tie-rod 98 is secured at its other end to waler 88 by wing nut 102 screwed against plate 106. The angled tie rod 98 tightly secures the outside corner joint and yet is easily disassembled. The complete outside corner assembly typically will have more than one tie rod 98 joining walers 86 and 88.

These ties 98 are preferably set at 45° to the joists 16*a*, 16*c*; but because of the spacing between flanges 90 and 92, this can be appreciably varied. This usually is not possible with the prior art.

When this outside corner form assembly is used in combination with the aforedescribed inside corner forming assembly 10, a tight and efficient corner wall mold is established.

One advantageous feature of the present invention is that specially dedicated accessory hardware is not needed. The bolts, clips, nuts, angles, and tie rods are all derived from existing equipment. Only the outside waler and the inside corner forming member are unique.

Another advantageous feature is that the inside corner forming member, normally secured to panel 12, need not be dedicated solely for forming corners. If necessary, panel 12 may be linearly joined to an adjacent panel, such as panel 14 in the manner shown in FIG. 6, in order to form a straight wall mold.

Referring more particularly to FIG. 6, there is illustrated a modified combination of panel 12 linearly secured to panel 14 through the L-shaped member 10. Instead of the angle 44 being secured to the leg 24 (such that panel 14 forms a right angle inside corner with panel 12); in FIG. 6 the angle 44 is fastened by one of its legs 44*b* to the outer face of leg 22 by a pair of wedge bolts 42 and 45 (through optional holes 40 in leg 22).

Thus, panels 12 and 14 may be used in combination to form a straight-wall mold by using optional apertures 40. This demonstrates the flexibility of L-shaped member 10. However, when the L-shaped member is used in the inside corner configuration shown in FIGS. 1–4, the apertures 40 would have to be fitted plugs 108, formed of plastic or other suitable material.

Modifications in the foregoing preferred embodiment may be made without departing from the spirit and scope of the invention. For example, include different fastening means to secure L-shaped member 10 to the respective panels and to the panel-support beam members. The particular dimensions of the respective legs of member 10 are not critical and may vary with different applications. Also, the particular panels with which this member is used need not be limited solely to flat plywood panels. For example, fiber glass panels shaped for architectural details may be used. Furthermore, various other applications of the corner forming member are within the scope of this invention in its broader aspects; including use on a wall form having wooden studs instead of aluminum joists 16 where the leg 24 would be clamped or otherwise affixed to the nearest stud (either directly or by shims, as may be necessary). Thus it can be compatible with most any wall form that a contractor may have in his inventory.

Although primarily intended for use in forming right angle walls of uniform thickness, the illustrated structure has some leeway for variability in the angle of the wall and/or in the top-to-bottom thickness. Also within the broader scope of the invention, the structure itself can be modified to mold different angles, shapes, or thicknesses.

As seen in dash-dot outline in FIG. 3, the length of said second portion 36 can be usefully employed to allow for accommodating different lengths of joists 16A and/or panels 12 (preferably by up to 3 inch variations).

Figure 7:
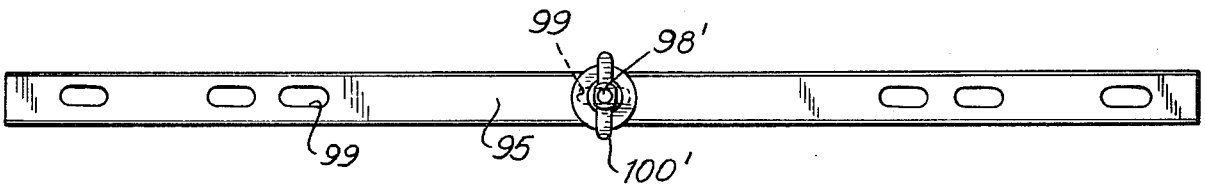
FIG. 7 is a plan view of a waler web and a tie rod and nut.

Referring to FIG. 7, only the web 95 of waler 86 has been diagrammatically shown, to illustrate the preferred shape and spacing of the aperatures 99 in a typical 4 inch wide web. Also shown are an alternative heavy duty tie rod 98' and heavy duty wing nut 100'. The latter has the advantage of being sufficiently large relative to the aperture 99 so that no plate 104 is needed (said plate 104 being an adaptor for the nuts 100 used with light-duty tie rods 98).

Two wall forms, each having its own L-shaped member, can be joined in linear orientation by securing the respective L-shaped member face-to-face. Thus referring to the linear orientation of panels 12 and 14 shown in FIG. 6, this structure would be modified by replacing the angle 44 by a second L-shaped member 10' (not shown) mounted on joist 16' and panel 14 (whereby leg 22' of L-shaped member 10' is joined face-to-face with the leg 22 of member 10).

Although illustrated for use vertically, the L-shaped member is also very usefully employed in a horizontal orientation (for example, in forming an overhead inside corner in a tunnel). Similarly, this horizontal orientation can be used in joining stacked wallforms vertically (this can be best visualized if one views FIG. 6 for this purpose as being rotated 90 degrees, such that the panels 12 and 14 are in a vertical plane).

What is claimed is:

1. An inside corner concrete forming member adapted for mounting on a free end of a first wall form panel and on at least one panel-support beam member fixed to such panel, said corner forming member being substantially L-shaped and having a seating flange projecting inwardly generally at right angles from an intermediate location along one leg of said L-shaped member, the extension of that portion of said one leg beyond said seating flange being substantially equal to the thickness of said panel and being adapted to shield said free end of said panel when the latter is seated at right angles to said one leg on said seating flange with said end abutting said extension; said other leg of said L-shaped member being adapted to be secured to said panel-support beam member and having first fastening means adapted for use in securing a separate wall form panel to said other leg such that the outer surface of said other panel and the outer surface of said one leg are substantially coplanar, and a second portion of said other leg for engaging said beam member and being inwardly offset sufficiently to afford stripping clearance back over said beam member by said other panel.

2. The inside corner forming member of claim 1, wherein the inner surface of that portion of said one leg which extends beyond said seating flange forms an acute angle with said seating flange, whereby the free end of said portion is slightly wider than that thickness of said portion where it joins the seating flange.

3. The inside corner forming member of claim 2, wherein said seating flange is provided with at least one hole to receive second fastening means for securing said one panel thereto.

4. The inside corner forming member of claim 1 wherein said other leg of said L-shaped member has a first portion which extends from said one leg at substantially a right angle, an angle portion that angles back on the side towards said seating flange, a second portion substantially parallel to said first portion, and said angle portion joining said first and second portions.

5. The inside corner forming member of claim 4 wherein said second portion of said other leg terminates in a flange adapted to be hooked to a fastening clip so as to be secured to said panel-support beam member.

6. The inside corner forming member of claim 4, wherein said first fastening means comprises at least one aperture in said first portion of said other leg.

7. The inside corner forming member of claim 4, comprising third fastening means for adjustably joining said second portion of said other leg relative to said panel-support beam.

8. The inside corner forming member of claim 1, wherein said L-shaped member has an alternate fastening means in said one leg comprising at least one aperture for securing said other panel to said leg coplanar with said first panel.

9. The inside corner forming member of claim 8, wherein said alternate fastening means include vertically aligned spaced apertures in the face of said one leg sized to receive conventional wedge bolts therein.

10. The inside corner forming member according to claims 1 to 5 or 9, wherein said L-shaped member including said seating flange are of unitary construction formed of extruded aluminum.

11. An inside-corner forming member for joining a pair of wall forms at right angles comprising an L-shaped elongated metal member having one leg with a rectangular planar outer side surface and a rectangular planar outer end surface which surfaces join together at right angles and define the inside-corner joint, first fastening means on the other leg closely adjacent to said one leg for use in demountably joining a wall form with its outer surface coplanar with said side surface of said one leg, second fastening means closely adjacent said end surface of said one leg for use in joining a separate wall form to said L-shaped member with the outer surface of said separate wall form being coplanar with said end surface, and a third fastening means for use in joining said other leg to said separate wall form remote from, yet offset in the general direction of, said second fastening means.

12. An inside-corner forming member for joining a pair of wall forms at right angles comprising an elongated L-shaped extruded aluminum member having one leg with two planar outer longitudinal surfaces which are at right angles to each other, said other leg having a first portion extending inwardly at right angles from its joinder with said one leg and having a further portion offset to the side in the direction of said one leg for stripping clearance.

13. An inside-corner forming member of claim 12, further comprising first fastening means on said first portion for use in joining a wall form thereto with its outer surface coplanar with the adjacent outer surface of said one leg and a second fastening means on said one leg adjacent its other outer surface for use in joining a separate wall form thereto with the outer surface of said separate wall form coplanar with said other surface of said one leg.

14. An outside-corner waler for a concrete wall form comprising a U-shaped channel having a pair of parallel major and minor legs joined at right angles by an apertured top web, said legs terminating at their free ends in flanges coplanar with each other, said legs being dimensioned with relative lengths such that said web makes about a 45° angle with the plane of said flanges.

15. A waler as claimed in claim 14, comprising upturned lips on the outer edge of said flanges adapted to mate with waler fastening means, said apertures in said top web being elongated along the length of said channel, said waler being extruded from aluminum.

16. A waler as claimed in claim 15 further comprising reinforcing washer means for receiving the compression forces from the nut of any tie rod positioned through said apertures to spread such forces over an enlarged area of said web.

17. An inside concrete form assembly, comprising a substantially L-shaped aluminum member having a seating flange projecting inwardly generally at right angles from an intermediate location along one leg thereof, the other leg of said L-shaped member having a first portion which extends from said one leg at substantially a right angle, an angle portion that angles back on the side towards the said seating flange, and a second portion substantially parallel to said first portion and joined thereto by said angle portion; a first wall form having a first panel, a portion of which panel seats on said seating flange, and an edge of which panel butts against that portion of said one leg that extends beyond said seating flange, the length of said portion of said one leg being substantially equal to the thickness of said one panel; a second wall form having a second panel; an angle member secured to an inner surface of said second panel; first fastening means for fastening said angle member to said other leg of said L-shaped member such that the outer surface of said second panel and the outer surface of said one leg of said L-shaped member are substantially coplanar; and third fastening means for fastening said second portion of said other leg to said first wall form.

18. The assembly of claim 17 wherein said first fastening means comprises at least one aperture disposed in said first portion of said other leg of said L-shaped member, a wedge bolt passing through said at least one aperture and through a mating opening in said angle member and having a slot therein, and a second wedge bolt disposed in said slot for securing said first wedge bolt in said aperture and mating opening.

19. The assembly of claim 17, further comprising at least one panel-support beam member secured to the inner surface of said one panel; and the portion of said wall form to which said second portion of said other leg is attached by said third fastening means is at least one panel-support beam member.

20. The assembly of claim 19 wherein said second portion of said other leg of said L-shaped member terminates in a flange; and wherein said panel-support beam member is an aluminum I-beam joist having a top hat section with a wooden nailer strip secured therein and centered in one face of said joist and a T-shaped bolt slot centered in the other face of said joist, and said third fastening means comprises a bolt and clip means secured in the bolt slot of at least one of said joists for hooking said flange.

21. Corner forming apparatus for a concrete form, comprising:

an outside corner form assembly comprising a pair of abutting wall forms disposed at substantially right angles and each having at least one panel backed by a plurality of horizontal panel-support beam members secured thereto, a pair of outside corner walers, each comprising a U-shaped channel having a pair of parallel major and minor legs joined at right angles by an apertured top web, said legs terminating at their free ends in flanges coplanar with each other, said legs being dimensioned with relative lengths such that said web makes about a 45° angle with the plane of said flanges, the first waler being fastened by its flanges across the panel-support beam members of said first outside wall form and adjacent the joint between said pair of outside wall forms, the second waler being similarly fastened to the panel-support beam members of the second outside wall form, the open channels of said walers facing each other, and at least one tie-rod and nut assembly positioned in said channels of said walers and extending through apertures in the respective top webs so as to rigidly connect said first and second walers; and an inside corner form assembly comprising a pair of first and second inside wall forms and an L-shaped member according to claim 17; and said inside corner form assembly and said outside corner form assembly being fixed relative to each other with a predetermined spacing by bracing means to give the desired corner wall form.

22. Corner forming apparatus for a concrete form, comprising:

an outside corner form assembly comprising a pair of abutting wall forms disposed at substantially right angles and each having at least one panel backed by a plurality of horizontal panel-support beam members secured thereto, a pair of outside corner walers, each comprising a U-shaped channel having a pair of parallel major and minor legs joined at right angles by an apertured top web, said legs terminating at their free ends in flanges coplanar with each other, said legs being dimensioned with relative lengths such that said web makes about a 45° angle with the plane of said flanges and each further comprising up-turned lips on the outer edge of said flanges adapted to mate with waler fastening means, said apertures in said top web being elongated along the length of said channel, said waler being extruded from aluminum, the first waler being fastened by its flanges across the panel-support beam members of said first outside wall form and adjacent the joint between said pair of outside wall forms, the second waler being similarly fastened to the panel-support beam members of the second outside wall form, the open channels of said walers facing each other, and at least one tie-rod and nut assembly positioned in said channels of said walers and extending through apertures in the respective top webs so as to rigidly connect said first and second walers; and an inside corner form assembly comprising a pair of first and second inside wall forms and an L-shaped member according to claim 18; and said inside corner form assembly and said outside corner form assembly being fixed relative to each other with a predetermined spacing by bracing means to give the desired corner wall form.

23. Corner forming apparatus according to claim 21 or claim 22 wherein said bracing means are tie rods extending between the inside corner form assembly and the outside corner form assembly and fastened respectively thereto, and said first inside wall form and said first outside wall form are parallel and similarly said second inside wall form and said second outside wall form are parallel.

* * * * *